US007014044B1

(12) United States Patent
Sadlier

(10) Patent No.: US 7,014,044 B1
(45) Date of Patent: Mar. 21, 2006

(54) CUP AND LID HOLDER AND DISPENSER

(75) Inventor: Claus E. Sadlier, Pleasanton, CA (US)

(73) Assignee: Insulair, Inc., Vernalis, CA (US)

( * ) Notice: Subject to any disclaimer, the term of this patent is extended or adjusted under 35 U.S.C. 154(b) by 152 days.

(21) Appl. No.: 10/794,745

(22) Filed: Mar. 5, 2004

(51) Int. Cl.
*B65D 21/00* (2006.01)
*B65D 85/62* (2006.01)

(52) U.S. Cl. ..... 206/546; 206/427; 206/499

(58) Field of Classification Search ..... 206/147, 206/153, 217, 427, 434, 499, 546; 229/103.2
See application file for complete search history.

(56) References Cited

U.S. PATENT DOCUMENTS 2,354,098 A * 7/1944 Bamber ..... 229/124
2,727,674 A * 12/1955 Rous ..... 206/429
3,083,891 A * 4/1963 Forrer ..... 206/434
3,182,794 A * 5/1965 Moore ..... 206/154
3,385,502 A * 5/1968 Pilger ..... 229/117.35
3,394,800 A * 7/1968 Brackett et al. ..... 206/196
3,443,681 A * 5/1969 Wysocki ..... 206/508
3,861,530 A 1/1975 Calvert
4,163,508 A 8/1979 Mannor
4,228,918 A 10/1980 Kellogg
4,239,125 A 12/1980 Pawlowski
4,319,680 A * 3/1982 Hiemstra ..... 206/461
4,328,891 A * 5/1982 Elward ..... 206/158
4,526,316 A * 7/1985 Sutherland ..... 206/194
4,541,526 A 9/1985 Berg et al.
4,574,997 A * 3/1986 Ikeda ..... 206/194
4,875,585 A * 10/1989 Kadleck et al. ..... 206/426
4,932,531 A 6/1990 Bakx
5,244,093 A * 9/1993 Carmichael et al. ..... 206/499
5,429,239 A 7/1995 Baxter
5,484,059 A * 1/1996 Sutherland ..... 206/434

(Continued)

OTHER PUBLICATIONS

S. C. Johnson, Ziploc Single Serving w/ Snap 'n Seal Lids, Nov. 2003, photo of product in retail store.

(Continued)

*Primary Examiner*—David T. Fidei
(74) *Attorney, Agent, or Firm*—David Pressman

(57) ABSTRACT

A cup and lid holder has two parts: a bottom part holds two stacks of insulated paper cups and a top part holds two stacks of mating lids. The holder is folded from a flat blank. The blank is one piece and folds into a two-level structure with three horizontal parts: a bottom, a partition to separate the lids from the cups, and a top. The bottom has two fold-up tabs that fit into the bottoms of the bottom cup of each stack to hold them in place. The top comprises two rings that fit around the turrets of the top lid of each stack to hold them in place. The middle partition rests against the tops of the top cup in each stack to hold the stack in position. The middle partition is formed of two sets of two tabs each that interfit and extend from the tops of the front and bottom walls. Two stacks of lids are loaded into the top part and two stacks of cups are loaded into the bottom part. The holder with the loaded lids and cups is shrink-wrapped and printed. The lids can be removed individually by lifting a top ring and pulling a lid out. Similarly the cups can be removed individually by tilting out the stack of cups and removing the top one. The holder can be made to hold one, rather than two stacks of cups and lids.

7 Claims, 5 Drawing Sheets

U.S. PATENT DOCUMENTS

| | | | | |
|---|---|---|---|---|
| 5,927,502 | A | 7/1999 | Hunter | |
| 6,213,293 | B1 * | 4/2001 | Marco | 206/147 |
| 6,568,585 | B1 * | 5/2003 | Marie | 229/103.2 |
| 2003/0071045 | A1 | 4/2003 | Taylor | |

OTHER PUBLICATIONS

SAFEWAY Reusable Containers with Snap-On Lids, Nov. 2003, photo of product in retail store.

Solo Make It To Go Cup, lid, and sleeve package, Nov. 2003, photo of product in retail store.

Dixie Perfectouch To Go Cup and lid package, Nov. 2003, photo of product in retail store.

Rubbermaid Servin 'Saver Package Cup and lid package, Nov. 2003, photo of product in retail store.

Gladware Containers Plastic container and lid package, Nov. 2003, photo of product in retail store.

* cited by examiner

CUP AND LID HOLDER AND DISPENSER

CROSS-REFERENCE TO RELATED APPLICATIONS

The invention of this application is a holder for cups and lids such as those disclosed in U.S. Pat. No. 6,422,456, (2002) (cup), and Des. 417,845 (1999) (lid), and previous patents cited therein. I incorporate the disclosures of all of these patents herein by reference.

BACKGROUND OF THE INVENTION

1. Field

This invention relates generally to holders and dispensers, specifically to a holder and dispenser for disposable hot drink cups and their lids.

2. Prior Art

To take out a hot beverage from one's home, or a store, or restaurant, one usually uses an insulated cup with a lid to keep the contents from spilling. Reusable insulated cups and lids of plastic or metal are available, but these are not suitable for restaurants or stores because of their cost, and are inconvenient for away from home use since they must be returned and washed. Paper or plastic disposable cups and lids are available and solve these problems, but heretofore it was difficult to store and dispense these since the cups had to be purchased or kept in one container or box and the lids in another container. Storing and keeping track of two separate containers or boxes was inconvenient and difficult. The cups and lids can also be kept in one container or a plastic bag, but it was difficult to keep them separate and remove one cup and one lid at a time.

OBJECTS AND ADVANTAGES

Accordingly, several objects and advantages of the invention are to provide (1) an improved container or holder and dispenser for cups and lids, (2) a holder that can hold and dispense both cups and lids, one at a time, and (3) a holder or dispenser for both cups and lids that is convenient to use and store. Other objects are to provide such a holder and dispenser that is economical, easy to use, disposable, can carry advertising, can dispense cups and lids separately, and can hold the cups and lids securely. Further objects and advantages will become apparent from a consideration of the ensuing description and the accompanying drawings.

SUMMARY

In accordance with the invention, a cup and lid holder has two parts: a bottom part holds two stacks of insulated paper cups and a top part holds two stacks of mating lids. The holder is folded from a flat blank. The blank is one piece and folds into a two-level structure with three horizontal parts: a bottom, a partition to separate the lids from the cups, and a top. The bottom has two fold-in tabs that fit into the recessed bottoms of the bottom cup of each stack to hold them in place. The top comprises two rings that fit around the turrets of the top lid of each stack to hold them in place. The middle partition rests against the tops of the top cup in each stack to hold the stack in position. Two stacks of lids are loaded into the top part and two stacks of cups are loaded into the bottom part. The holder with the loaded lids and cups is shrink-wrapped and printed. The lids can be removed individually by lifting a top ring and pulling a lid out. Similarly the cups can be removed individually by tilting out the stack of cups and removing the top one. The holder can be made to hold one, rather than two stacks of cups and lids.

DRAWINGS—FIGURES

REFERENCE NUMERALS

10B bottom
10BT bottom tabs
10F front wall
10FN top neck of front wall
10FT front interlocking tab of partition
10I imprinting
10LT, 10LT' interlocking tabs
10P intermediate partition
10R rear wall
10RN top neck of rear wall
10RT rear interlocking tab of partition
10T top
12A stack of lids
12B stack of lids
12D drinking opening
12T turret
14A, 14B stacks of cups
16 shrink wrap

DETAILED DESCRIPTION:—PREFERRED EMBODIMENT

Figure 1:
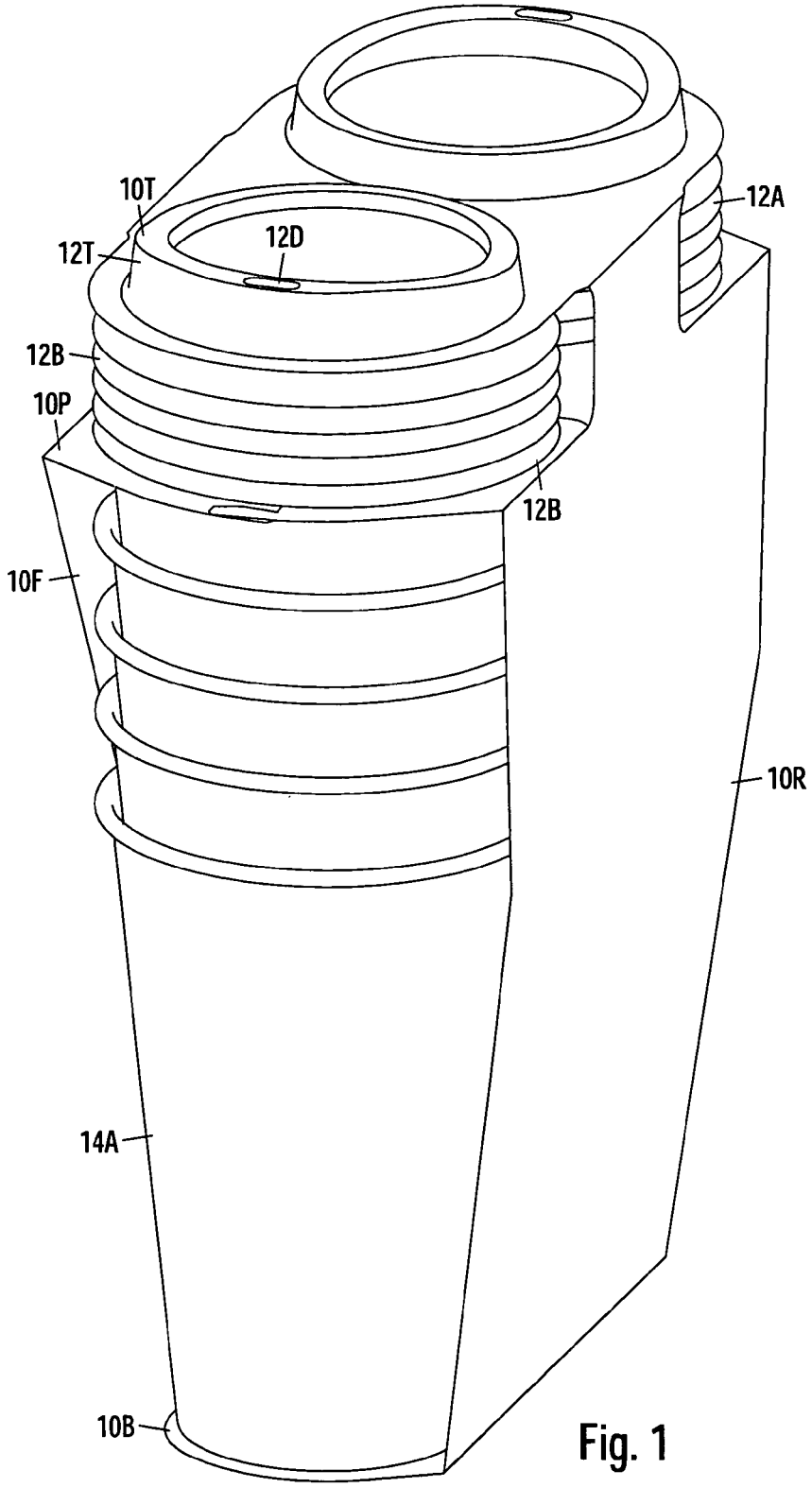
FIG. 1 is a perspective view of a lid and cup holder according to the invention, loaded with two stacks of cups and lids.

FIG. 1—Perspective View

FIG. 1 shows a perspective view of a cup and lid holder according to the invention. The holder comprises a top 10T, an intermediate shelf or partition 10P, a bottom 10B, a front wall 10F, and a rear wall 10R. The holder is shown holding two stacks of lids 12A and 12B and two stacks of cups, but only one stack of cups 14A is visible in FIG. 1. Each lid is like that shown in my above design patent, i.e., it has a base that mates securely with the upper curled or rolled rim of a cup and an upstanding turret 12T with a drinking opening 12D. Note that the two stacks of lids rest on top of partition 10P. Top 10T has two large holes or rings and the turret of the top lid in each stack extends up through a respective hole. The two stacks of cups rest on bottom 10B and extend up to the underside of partition 10P. The cups fit securely between bottom 10B and partition 10P. The holder thus is able to hold securely ten cups in two stacks of five each and ten mating lids in two similar stacks.

Figure 2:
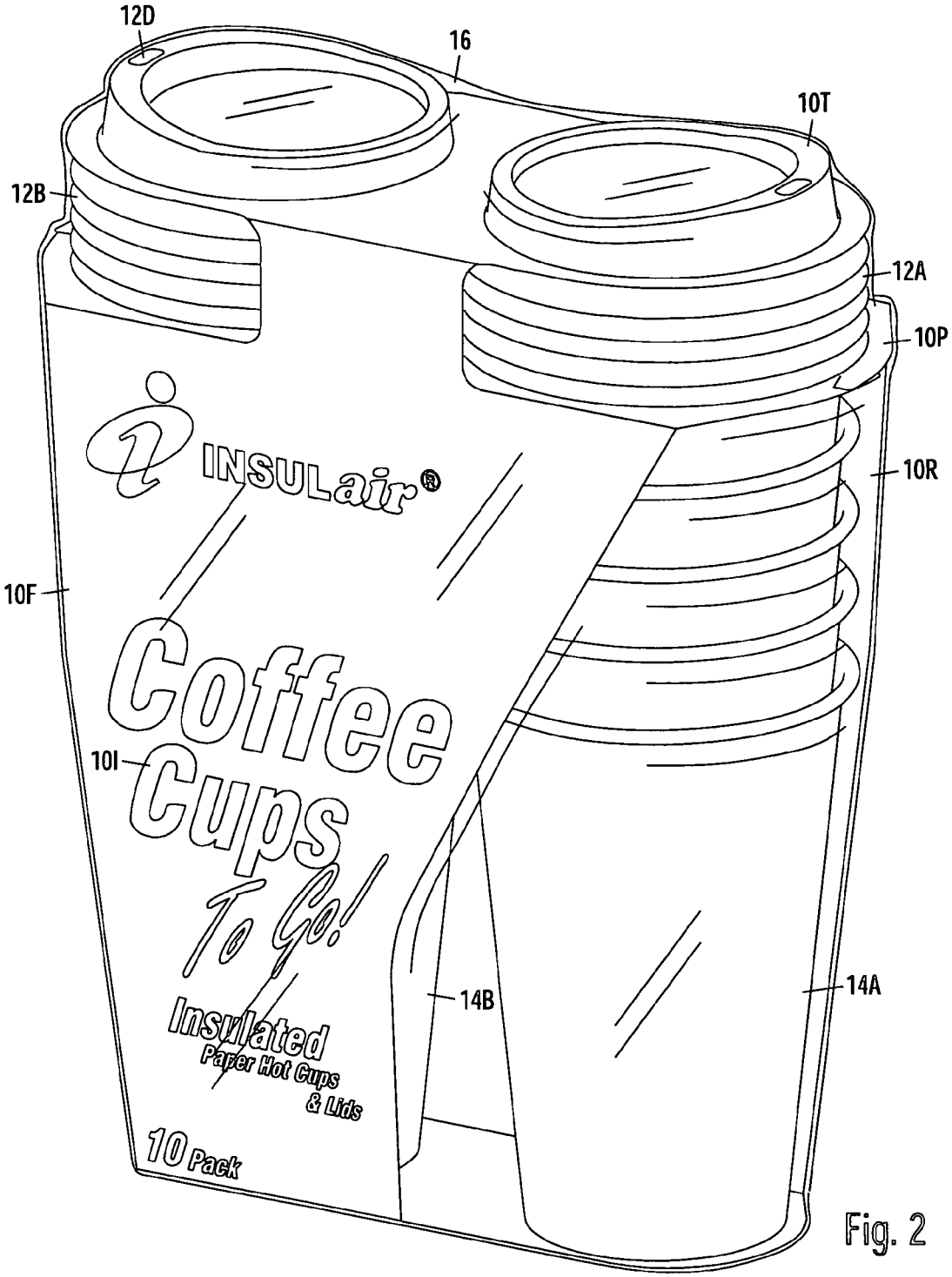
FIG. 2 is a different perspective view of the holder with shrink wrapping and imprinting.

FIG. 2—Perspective View of Shrink Wrapped Holder

The cup- and lid-loaded holder of FIG. 1 is shown in FIG. 2 with front wall 10F printed with suitable labeling and a layer 16 of flexible, transparent plastic sheeting completely wrapped around the loaded holder. Layer 16 is installed around the loaded holder by a well-known heat-activated shrink wrapping process and will be referred to as a shrink-wrap. Front wall 10F and rear wall 10R (not shown) are imprinted with descriptive indicia 101. Shrink-wrap 16 keeps the cups and lids sanitary and secure in the holder so they will not fall out during shipping and handling.

Figure 3:
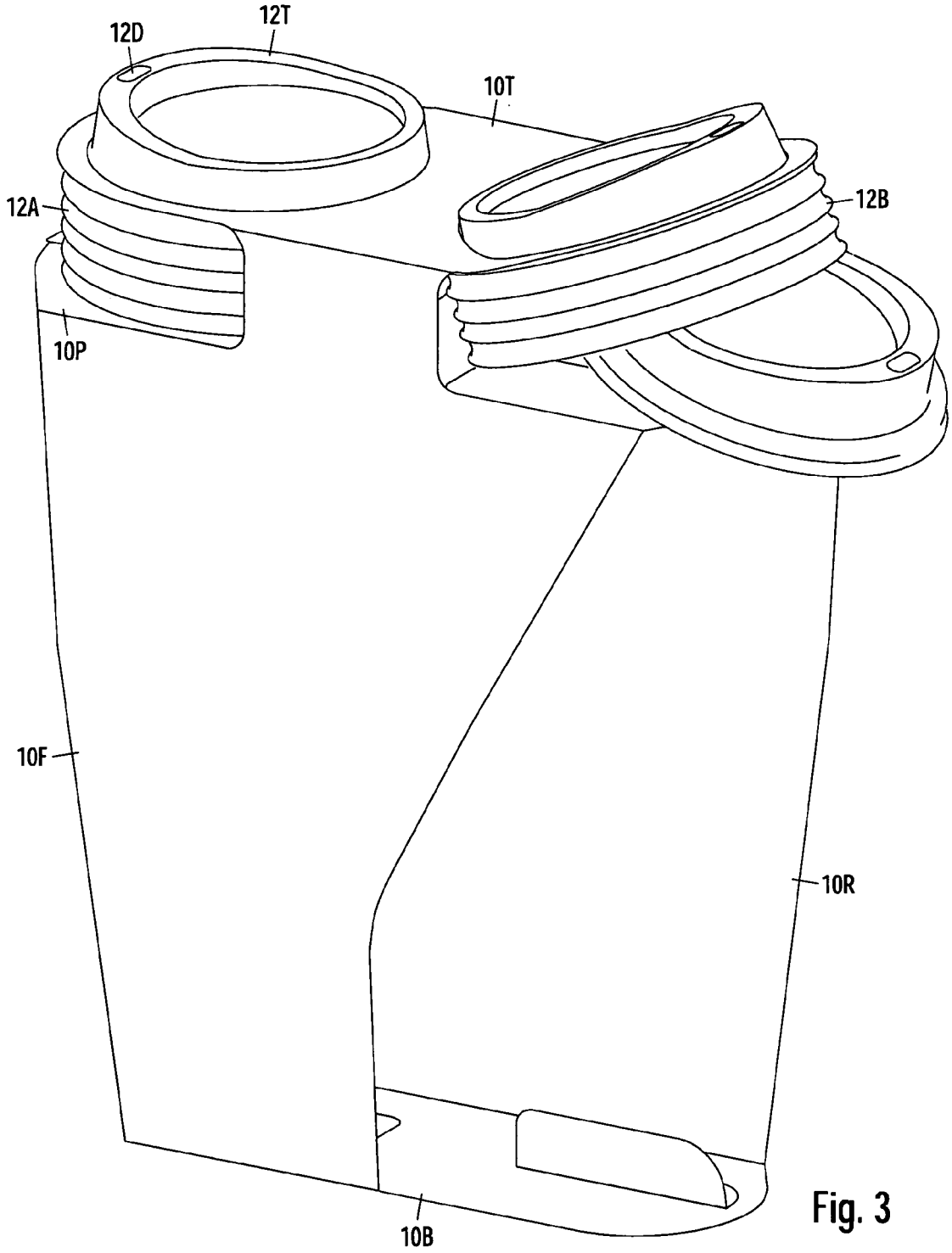
FIG. 3 is a perspective view of the holder without cups and with a single lid being removed.

FIG. 3—Perspective View—Lid Being Dispensed

FIG. 3 shows a perspective view of the holder (cups removed for clarity) with a lid being dispensed or removed. To remove a single lid, top 10T is lifted slightly at one end by lifting up one stack of lids 12B. The half of top 10T that holds this stack of lids bends upwardly as shown so that the bottom lid of the stack, which extends up into the bottom of the next lid up, can be lowered out of the next lid up and pulled out of the stack. Then the stack is released so that the upwardly bent half of top 10T bends back to a horizontal orientation to hold the lids again. (To remove a single cup from a stack, the stack is tilted outwardly (not shown), the top cup is lifted out, and the stack is returned to its upright position in the holder.)

Figure 4:
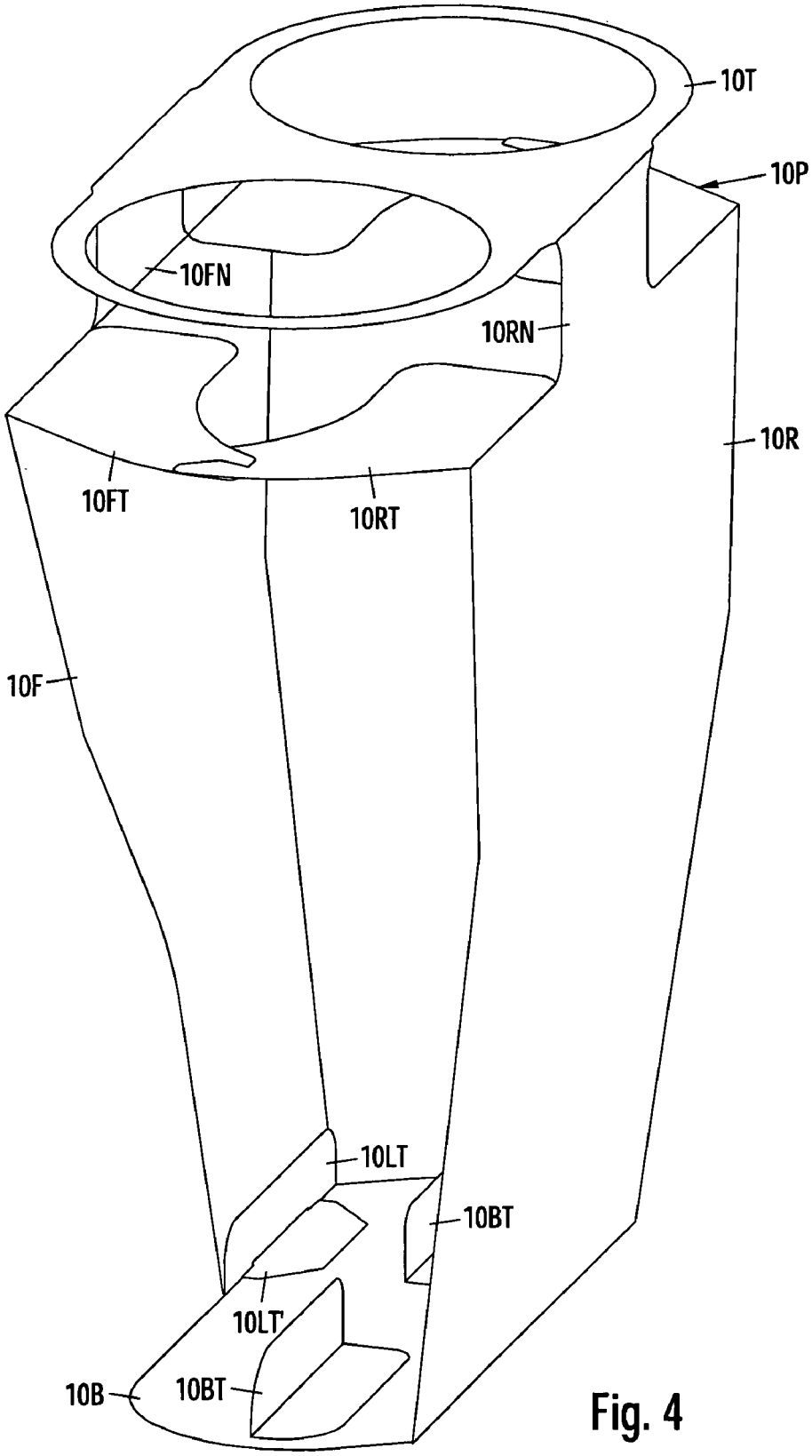
FIG. 4 is a perspective view of the holder without any cups or lids.

FIG. 4—Perspective View—Details of Holder

Figure 5:
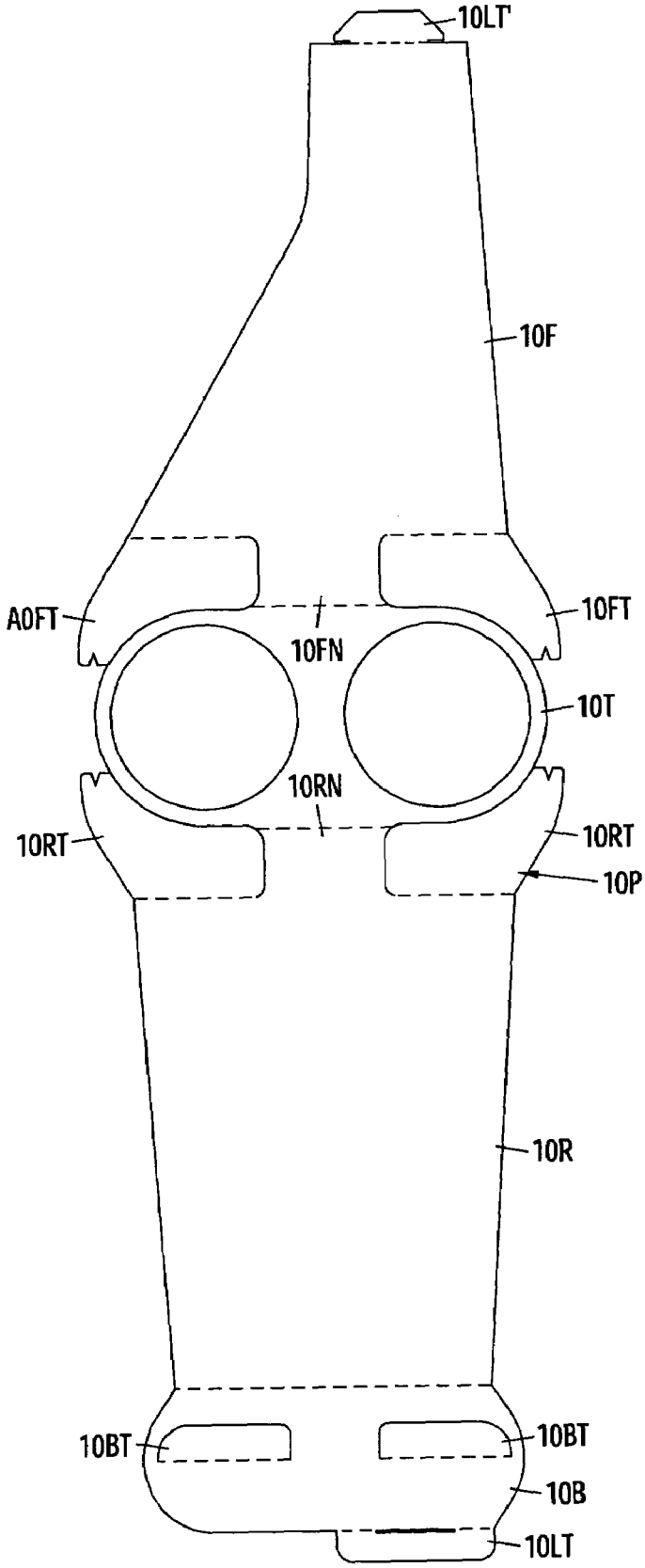
FIG. 5 is a plan view of a starting blank which is folded to make the holder.

The details of the holder are best shown in FIGS. 4 and 5. FIG. 4 shows the holder assembled and without any cups or lids loaded into it. The holder preferably is made of white solid bleach sulfite (SBS) cardboard, 0.5 mm thick, but it can be made of rigid plastic or cardboard or paper of a different thickness or type.

Bottom 10B of the holder is rectangular with rounded ends. It contains two identical fold-up tabs 10BT that are cut out of the bottom and extend up into the bottom recesses of the bottom cups in the stacks to prevent the cups from sliding out of the holder. The bottom has two openings where the tabs are cut out and folded up, but these do not adversely affect the performance of the holder. The left side of the bottom as shown in FIG. 4 and in FIG. 5 has a female tab 10LT that is partially slit in the center of its junction with bottom 10B. The bottom of front 10F has a male tab 10LT' that is partially slit at the ends of its junction with front 10F. Thus the male tab can be inserted into and interlock with the female tab shown in FIG. 4.

Front wall 10F is elongated and has a narrow bottom from which male locking tab 10LT extends and a widened top part that joins partition 10P. It has a top neck 10FN that joins one side of top 10T. Rear wall 10R is elongated, rectangular, and flares slightly from bottom to its top, where it joins partition 10P. The rear also has a top neck 10RN that joins the other side of top 10T.

Partition 10P actually consists of two panels or shelves, each consisting of two interlocking tabs. The panels or shelves are spaced apart by necks 10RN and 10FN. Two tabs 10FT extend from front wall 10F, and two tabs 10RT extend from rear wall 10R. As best seen in FIG. 5, each tab has a straight base that is joined to a shoulder of the front or rear wall and has a generally rectangular shape with a stretched up and curved corner extension having a narrow tip with a notch. As shown in FIGS. 4 and 5, the notch at the tip of each front tab 10FT mates with the corresponding notch of a respective back tab 10RT to form a panel or shelf of the partition. The partition separates the cups from the lids and the folded-in tabs provide four windows to expose the lids from the front and rear for display pruposes.

Top 10T is integrally joined to and between the tops of necks 10RN and 10FN. It consists of two interconnected rings, i.e., a generally rectangular member with curved ends and two large circular cutouts or holes to accommodate the respective turrets of the top lids in the two stacks of lids 12B (FIG. 1). When the holder is loaded with lids and cups (FIGS. 1–3) the holes in the top hold the top lid and hence the stack of lids securely and thus stabilize the package and allow the top lid to be visible for retail display purposes.

FIG. 5—Blank

FIG. 5 shows the blank which is folded and tab-locked to provide the holder of FIG. 4. The blank of FIG. 5 is made from a rectangular starting sheet of cardboard (not shown) which is cut according to the solid lines and scored or indented for easy and accurate folding according to the broken lines. In one embodiment that was designed to hold two stacks of five each 13.5 cm high 473 cc (16 fl. oz.) paper cups, the overall length of the blank was 62 cm and all other dimensions were sized proportionately as shown.

Starting from the bottom of FIG. 5, note that bottom 10B has partially scored and partially cut female locking tab 10LT extending from one side and is integrally joined to rear wall 10R at a score (broken) line at its other side. Rear 10R is integrally joined to tabs 10RT at a score line at its top side as shown. Tabs 10RT form half of each shelf of partition 10P and are shaped as described. Rear wall 10R also has neck 10RN at the middle of its top side which is joined to the bottom side of top 10T at a score line.

Starting from the top of FIG. 5, the top of front wall 10F is joined to partially cut male locking tab 10LT', and its bottom has neck 10FN at the middle, which is joined to the top side or top 10T at a score line. Front 10F is integrally joined to tabs 10FT at score lines at its bottom side as shown. Tabs 10FT form the other half of each shelf of partition 10P and are shaped as described.

OPERATION—PREFERRED EMBODIMENT

The setup and operation of the holder are as follows:

A manufacturer or factory starts with the blank of FIG. 5, which has been cut from a larger flat sheet. After suitable imprinting as shown in FIG. 2, the user sets up or forms the holder from the blank by folding along the broken lines as follows: Bottom 10B (FIG. 5) is folded up toward rear wall 10R, bottom locking tabs 10LT and 10LT' are folded up, partition-forming tabs 10RT and 10FT are also folded up, and front wall 10F and rear wall 10R are folded up with respect to top 10T. Then bottom male tab 10LT' is inserted into bottom female tab 10LT to lock the front to the bottom. Thus the holder can be formed into a closed sleeve without the use of a gluing step. Alternatively the two tabs can be overlapped and glued together. Also the user fits the notches on tabs 10RT and tabs 10FT together to form two-part partition 10P so that the holder will assume its final configuration of FIG. 4. Alternatively these tabs can be overlapped and glued together.

Next two stacks of five cups each are placed on bottom 10B so that tabs 10BT fit into the recesses on the bottom cups to prevent the stack of cups from sliding out of the holder. The tops of the two top cups rest against the bottom of partition 10P. Then the user loads ten lids in two stacks of five each onto the top of partition 10P so that the turrets of the top lid in each stack fits into the openings in top 10T. Top 10T can be bent up slightly at each end to facilitate this.

The holder is now fully loaded with cups and lids and will appear as in FIG. 1. The user or factory then wraps the loaded holder with a plastic shrink wrap 16, as shown in FIG. 2.

A consumer uses the holder and the cups as follows. Assume that a home user has purchased a holder as shown in FIG. 2 and wants to remove a cup to take a hot beverage to work. The user removes the shrink wrap, lifts up one end of top 10T slightly as shown in FIG. 3 and removes one lid from the bottom of the stack. The partition formed by the folded-in tabs is strong enough to hold the lids in place during such removal. They release the top and then tilt out one stack of cups and remove the top cup from the stack. Then they fill the cup with the desired hot beverage and install the lid and carry the beverage in the insulated cup wherever desired.

CONCLUSION, RAMIFICATIONS, AND SCOPE

Accordingly the reader will see that, according to the invention, I have provided an improved container or holder and dispenser for cups and lids that can hold and dispense both cups and lids, one at a time, and that is convenient to use and store. The holder is very economical, is very easy to use, is disposable, can carry advertising, can dispense cups and lids separately, and can hold cups and lids securely, While the above description contains many specificities, these should not be construed as limitations on the scope of the invention, but as exemplifications of the presently preferred embodiments thereof. Many other ramifications and variations are possible within the teachings of the invention. For example, the container can hold fewer or more than two stacks of cups and lids. Each stack can contain fewer or more than 5 cups and lids. It can have any size, according to the size and quantity of cups and lids it carries. It can be made of any suitable material, and is not limited to paper or cardboard. The shapes of the front and rear walls can be narrower or larger and can even enclose four sides, rather than two. Instead of using interlocking tabs 10LT and 10LT', overlapping glue flaps (not shown) can be used at each of these locations to attach the front to the bottom to form a closed holder. Similarly, front and rear tabs 10FT and 10RT, which form partition 10P, can be glued rather than interlocked together. The holder can be collapsed and delivered in a flat folded configuration by adding a fold line (not shown) through the middle of top section 10T and an corresponding fold line (not shown) through the middle of bottom section 10B. When the holder is folded flat at these two fold lines and then opened to receive cups and lids, bottom tabs 10BT will automatically pop up to receive the recessed bottom of a cup. The front and rear walls can also be foraminous and the various parts can be glued together, rather than folded from a blank. The partition can be eliminated so that the bottom lid of each stack is mated with the rim of the top cup of the stack. The holes in the top can be eliminated and preferably replaced by holding rings, tabs, or notches under the top.

Thus the scope of the invention should be determined by the appended claims and their legal equivalents, and not by the examples given.

The invention claimed is:

1. A holder for holding at least one stack of cups, each having an upper rim, and at least one stack of mating lids, each having a bottom side that is shaped to mate with said upper rim of one of said cups, and a top side having an upstanding turret, said stack of lids including a top lid, comprising:

a sheet of material having four sections as follows: a bottom section with front and rear edges, a top section with front and rear edges, a front side connecting said front edge of said bottom with said front edge of said top, and a rear side connecting said rear edge of said bottom with said rear edge of said top so as to form a four-sided enclosing structure or configuration, said top section having at least one aperture therein for receiving and holding said turret of said top lid when said stack of lids is positioned under said top section, whereby said holder can hold a stack of cups with a stack of lids positioned over said stack of cups with said turret of said top lid positioned in said aperture of said top section, and a partition or shelf between and generally parallel to said top section and said bottom section, whereby said partition can separate said stack of lids from said stack of cups so that said holder can hold a stack of cups under said partition and a stack of lids positioned over said partition.

2. The holder of claim 1 wherein said top section has at least two apertures therein for receiving and holding the turrets of the top lids of at least two stacks of lids positioned under said top section.

3. The holder of claim 2 wherein said holder is sized to hold two stacks of cups and said bottom section contains two fold-up tabs for mating with the respective recesses in the bottom cups of said two stacks of cups so as to prevent each of said stacks from sliding out of said holder.

4. The holder of claim 1 wherein said partition comprises at least one pair of tabs folded out of said front and rear sides, respectively, and toward each other so as to lie generally perpendicular to said front and rear sides and form said partition.

5. The holder of claim 1 wherein said top section has at least two apertures therein for receiving and holding the turrets of the top lids of at least two stacks of lids positioned under said top section, and wherein said partition comprises two pairs of tabs, each pair folded out of parts of said front and rear sides, respectively, and toward each other so as to lie generally perpendicular to said front and rear sides and form said partition, each pair of tabs being spaced from the other pair of tabs and a neck portion of said front and rear walls between said parts of said front and rear walls being generally perpendicular to said partition and joined to said top section.

6. The holder of claim 5 wherein each of said tabs has a notch at an end thereof that is mated with the other tab of its pair.

7. The holder of claim 6, further including a stack of cups and a stack of lids positioned in said holder and a transparent shrink wrap enclosing said holder with said cups and lids therein.

* * * * *